US009238502B2

(12) United States Patent
Shackcloth

(10) Patent No.: US 9,238,502 B2
(45) Date of Patent: Jan. 19, 2016

(54) MARINE SURVIVAL POD

(75) Inventor: Glen Shackcloth, Goodwood (AU)

(73) Assignee: PFG GROUP PTY LTD, Goodwood, Tasmania (AU)

( * ) Notice: Subject to any disclaimer, the term of this patent is extended or adjusted under 35 U.S.C. 154(b) by 116 days.

(21) Appl. No.: 14/112,662

(22) PCT Filed: Apr. 18, 2012

(86) PCT No.: PCT/AU2012/000396

§ 371 (c)(1),
(2), (4) Date: Dec. 5, 2013

(87) PCT Pub. No.: WO2012/142655

PCT Pub. Date: Oct. 26, 2012

(65) Prior Publication Data

US 2014/0087609 A1 Mar. 27, 2014

(30) Foreign Application Priority Data

Apr. 20, 2011 (AU) ..... 2011901496

(51) Int. Cl.

| | |
|---|---|
| ***B63B 35/58*** | (2006.01) |
| ***B63C 9/04*** | (2006.01) |
| ***B63C 9/08*** | (2006.01) |
| ***B63B 3/08*** | (2006.01) |
| ***A63B 69/14*** | (2006.01) |
| ***B63C 9/20*** | (2006.01) |
| ***B63C 9/22*** | (2006.01) |

(52) U.S. Cl.

CPC . *B63C 9/04* (2013.01); *A63B 69/14* (2013.01); *B63B 3/08* (2013.01); *B63C 9/08* (2013.01); *B63C 9/082* (2013.01); *B63C 9/20* (2013.01); *B63C 9/22* (2013.01)

(58) Field of Classification Search

CPC ..... B63C 9/04; B63C 9/08; B63C 9/82; B63C 9/22; B63C 9/20; B63B 3/08; B63B 35/58; A63B 69/14

USPC ..... 114/35, 36, 32, 80, 82, 83, 129

See application file for complete search history.

(56) References Cited

U.S. PATENT DOCUMENTS

| | | | | |
|---|---|---|---|---|
| 2,320,288 | A * | 5/1943 | Margolin et al. | 441/35 |
| 2,474,479 | A * | 6/1949 | Justice | 441/43 |
| 2,859,458 | A * | 11/1958 | Calarco | B63C 9/04 441/44 |
| 3,045,262 | A * | 7/1962 | Mitchell | 441/136 |
| 4,523,913 | A | 6/1985 | Kaino | |
| 5,102,360 | A * | 4/1992 | Eycleshimer | 441/80 |
| 5,234,144 | A | 8/1993 | Iler | |

FOREIGN PATENT DOCUMENTS

WO 2010/051596 A1 5/2010

* cited by examiner

*Primary Examiner* — Anthony Wiest
(74) *Attorney, Agent, or Firm* — Richard M. Goldberg

(57) ABSTRACT

A floatation survival pod includes an elongate floatation body (1) having sufficient buoyancy to remain afloat when holding a plurality of persons, handles (4) formed on the sides (5) thereof for grasping by the persons, one or more ports (6) formed in the top and bottom of said body for receiving and mounting a flare or the like and two or more compartments (7) formed either side of the longitudinal axis of said body for storing survival tools wherein the compartments provide access to the survival tools when the pod is floating in any orientation without compromising the floatation of the pod or comprising the security of persons using the pod.

9 Claims, 2 Drawing Sheets

MARINE SURVIVAL POD

CROSS-REFERENCE TO RELATED APPLICATIONS

The present application claims priority from Australian Provisional Patent Application No 2011901496, the content of which is incorporated herein by reference.

BACKGROUND OF THE INVENTION

This invention relates to a floatation device adapted for use in emergency situations where waterborne vessels, either in marine freshwater situations, encounter situations that threaten the vessel's ability to remain afloat and necessitate the evacuation of personnel aboard the vessel into the water.

The occurrence of emergencies in boats and other floatation vessels requiring the evacuation of personnel often places such evacuees in highly perilous circumstances reliant on quick reflexes and access to various emergency and survival tools prior to evacuation, including life jackets, flares, first-aid kits, thermal blankets etc. To date such emergency equipment is generally held in a variety of places around any given vessel and is not centrally located or readily available for access during emergencies, particularly by people unfamiliar with the vessel in question.

It will highly desirable to provide a single readily identifiable device for use as a floatation tool where the device in question also functions to accommodate and render readily available a range of emergency survival tools and equipment required by evacuees without necessitating the location of such equipment from a range of positions in different vessels.

SUMMARY OF THE INVENTION

In a first aspect the invention provides a floatation survival pod comprising: a floatation body having sufficient buoyancy to remain afloat when holding a plurality of persons, handles formed on the sides there of for grasping by said persons, one or more ports for receiving and mounting a flare or the like and one or more compartments for storing tools for survival wherein said compartments provide access to said survival tools when said pod is floating without compromising the floatation of said pod or compromising the security of persons anchored to said pod.

In another aspect the invention provides a floatation survival pod comprising an elongate floatation body having sufficient buoyancy to remain afloat when holding a plurality of persons, handles formed on the sides thereof for grasping by said persons, one or more ports formed in the top and bottom of said body for receiving and mounting a flare or the like and two or more compartments formed either side of the longitudinal axis of said body for storing survival tools wherein said compartments provide access to said survival tools when said pod is floating in any orientation without compromising the floatation of said pod or comprising the security of persons using said pod.

The pod may include cassettes removably fitted to the compartments formed in the ends of said body.

The cassettes are preferably cylindrical in configuration and have a threaded cap for sealing.

The cassettes preferably fit snugly into said cassette ports and are held in place by compliant seals.

The body is preferably generally symmetrical and elongate. The body preferably includes a centrally positioned longitudinal axis about which the pod will preferentially rotate in rough water conditions.

In a particularly preferred configuration the compartments and associated cassettes are positioned either side of the longitudinal axis.

BRIEF DESCRIPTION OF THE DRAWINGS

The invention will now be described in greater detail with reference to on particularly preferred embellishment shown in the figures and legend.

LEGEND

Figure 1:
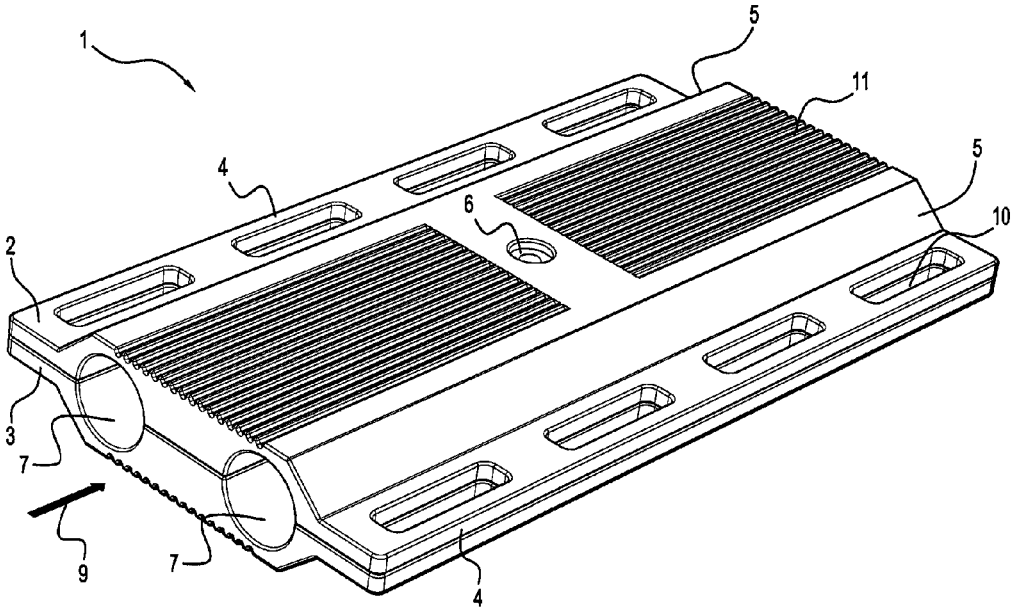
FIG. 1 shows the survival pod in perspective view.
Figure 2:
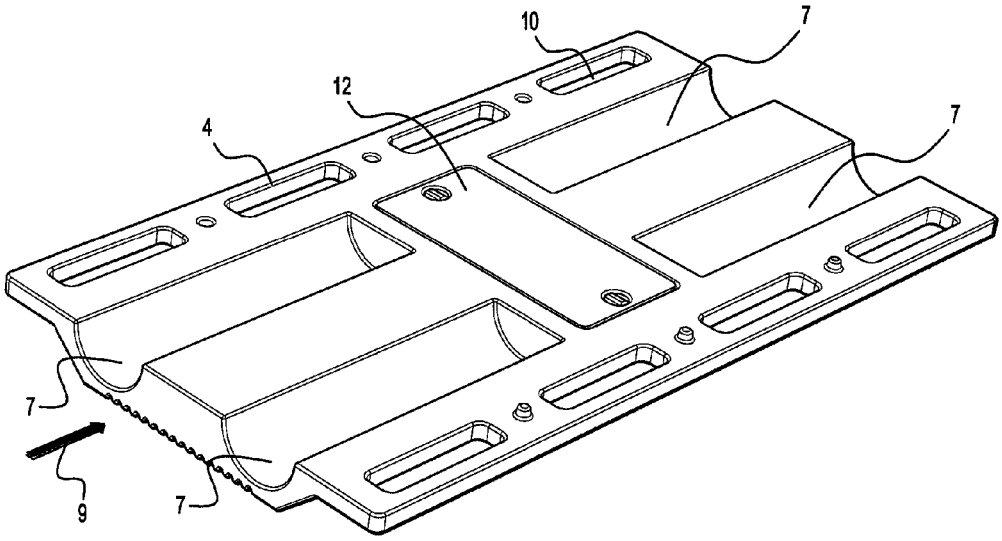
FIG. 2 shows a first half of the pod body.
Figure 3:
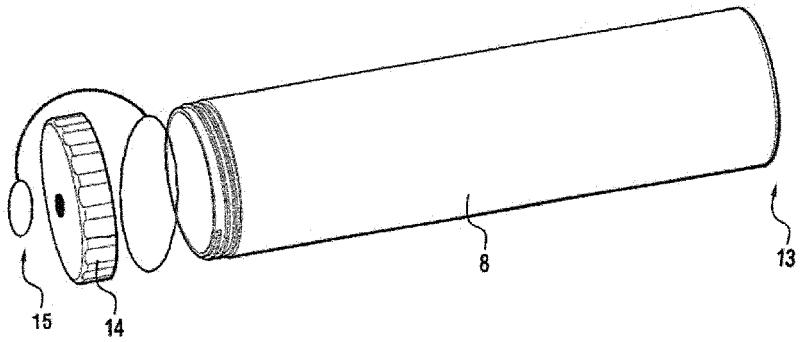
FIG. 3 shows a cassette.
Figure 4:
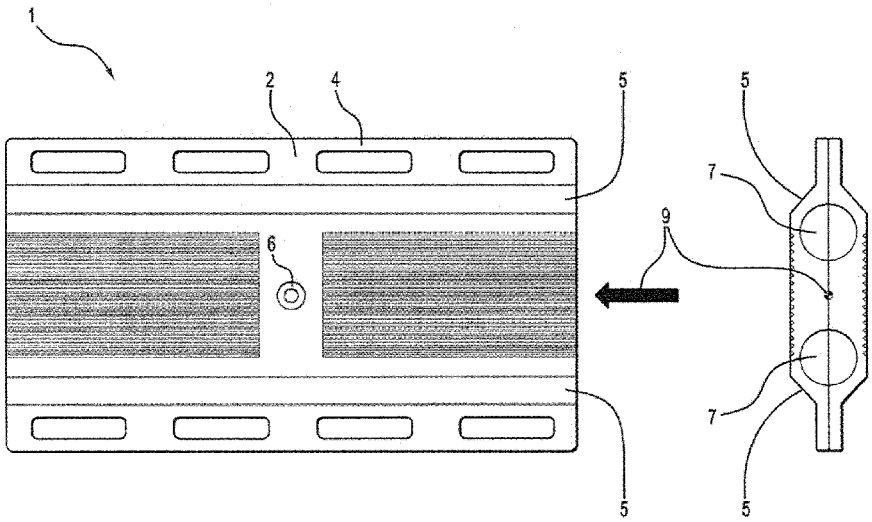
FIG. 4 shows a schematic plan and end view of the survival pod.

1. Floatation body
2. First half
3. Second half
4. Handles
5. Sides
6. Flare port
7. Compartment/Cassette port
8. Cassette
9. Longitudinal axis of rotation
10. Lashing aperture
11. Tread grip
12. Sealed compartment

DETAILED DESCRIPTION

Referring to the figures and legend, the invention will be described with reference to one particularly preferred embodiment where the marine or freshwater survival pod of the invention includes a floatation body 1 preferable made up of a first half 2 and second half 3 of substantially identical configuration adapted to nest and locate by suitable locking pins together so as to form a unitary floatation body 1 of generally flat and elongate planar configuration being adapted to support a plurality of persons seeking buoyancy or floatation assistance after escape from a stricken vessel.

The generally elongate configuration of the floatation body includes a centrally positioned longitudinal axis 9 about which the pod will preferably rotate if subjected to sufficient wave or turbulence forces. The central positioning of the longitudinal axis of rotation allows the pod to adopt a functional position in the water including access to lashing points, access to survival equipment stored in one or more of the cassettes and access to the principal safety features, regardless of the orientation of the pod in the water.

The floatation body 1 is formed of a suitable plastic material and is preferably moulded in a hollow configuration to improve buoyancy. The floatation body formed of a first and second half includes a generally elongate handle 4 on either side 5 running the substantial length of the floatation body. The handle 4 may include a plurality of lashing apertures 10 adapted to receive ropes or the like for floatation assistance to persons in need.

The upper and lower surfaces of the first and second body halves may include a tread grip 11 or the like so as to assist persons seated or grasping the top of the floatation body. The floatation body is preferable generally symmetrical so it is irrelevant how the survival pod is delivered into the water. The survival pod may include one or a plurality of ports 6 on the top and bottom thereof, particularly adapted for receiving and holding flares such that the flares can be activated and remain out of the water. The symmetrical shape of the body ensures availability of the flare ports regardless of the orientation of the pod.

The floatation body 1 includes a plurality of compartments 7 in the form of generally longitudinal ports formed in either end of the floatation body 1. The ports are preferably formed as banks of two or three at either end penetrating to half the length of the body.

The ports are adapted to receive and snugly engage a cassette 8 and may function as dedicated cassette ports. The cassettes are adapted to house a range of essential survival equipment, including additional flares, first-aid kits, thermal blankets, ropes, further life jackets etc. Each cassette 8 is provided with a sealed end 13, and an open end sealed by a screw lid 14 as an openable cap such that the cassette can be snugly engaged into the cassette port, preferably suitably engaged by way of a compliant seal 15 or the like. The cassette ports are fitted with loaded cassettes which remain attached to the floatation body as it is delivered in to the water, but are available for removal once the survival pod is in the water. The removal of one or more of the cassettes 8 from the cassette ports 7 does not compromise the floatation of the body nor does the removal of the cassettes interfere with the personnel either on the floatation body 1, holding the handles 4, or being lashed to the survival pod. Moreover, the generally symmetrical shape of the body and the central longitudinal axis 9 ensure that at least one or two of the cassettes positioned either side of the longitudinal axis remain out of the water in the event that the pod is swamped by a large wave and caused to rotate.

In this manner, duplication of survival equipment in each of the pods maximises the ability of pod users to retrieve the required survival tools in adverse conditions, regardless of the orientation of the pod.

The body may also include a dedicated sealed compartment 12 for holding sensitive electronic equipment including radios, telephones, satellite equipment, GPS equipment etc. In addition, the sealed compartment may be furnished with additional long-term survival equipment, including water, compact energy food, fire starter equipment and first-aid equipment.

In use the survival pod of the invention provided a singular readily identified survival aid for use on a vessel where the survival pod can be instantly recognised for its purpose and remain readily at hand for urgent deployment in times of emergency or sinking of a stricken vessel. The survival pod of the invention eliminates the need to urgently locate emergency equipment during an evacuation and provides a ready means of checking for presence of survival gear prior to each departure of the vessel. During an emergency, the personnel on the vessel can have confidence that all the appropriate survival equipment is readily available and at hand. The configuration of the pod body and provision of equipment cassettes either side of a preferred axis of rotation maximise the availability of stored equipment and minimise the risk of losing same in adverse conditions.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

What is claimed is:

1. A floatation survival pod comprising:

an elongate floatation body having a centrally positioned longitudinal axis and being symmetrical about a horizontal plane containing the longitudinal axis, and having buoyancy to remain afloat when holding a plurality of persons, handles integrally formed as one-piece with the floatation body and on sides thereof for grasping by said persons, at least one port formed in a top and bottom of said body for receiving and mounting at least a flare and at least two compartments formed either side of the longitudinal axis and formed in an end of said body for storing survival tools, wherein said compartments are configured to provide access to said survival tools when said pod is floating in any orientation without compromising floatation of said pod and without compromising the security of persons using said pod.

2. A survival pod according to claim 1 further including at least two cassettes removably fitted into said compartments and adapted for housing said survival tools.

3. A survival pod according to claim 2 wherein said cassettes are generally cylindrical in shape with a first sealed end and a second open end sealed with an openable cap.

4. A survival pod according to claim 2 wherein said cassettes are configured to engage with said compartments, said cassettes including a compliant seal to cooperate with a respective said compartment and hold said cassettes in place.

5. A survival pod according to claim 2 comprising four said cassettes fitted to four said compartments as two pairs either end of said body.

6. A survival pod according to claim 2 comprising six said cassettes fitted to six said compartments as two sets of three, either end of said body.

7. A survival pod according to claim 1 further including at least two cassettes removably fitted into said compartments and adapted for housing said survival tools and wherein said compartments and associated cassettes are positioned symmetrically either side of said longitudinal axis.

8. A survival pod according to claim 1 wherein said body includes tread grips formed on upper and lower surfaces thereof.

9. A survival pod according to claim 1 wherein said body is formed in two halves separating upper and lower surfaces thereof.

* * * * *